US008979611B2

(12) United States Patent
Sato et al.

(10) Patent No.: US 8,979,611 B2
(45) Date of Patent: Mar. 17, 2015

(54) POLISHING PAD, PRODUCTION METHOD FOR SAME, AND PRODUCTION METHOD FOR GLASS SUBSTRATE

(75) Inventors: Akinori Sato, Osaka (JP); Nobuyoshi Ishizaka, Osaka (JP)

(73) Assignee: Toyo Tire & Rubber Co., Ltd., Osaka (JP)

( * ) Notice: Subject to any disclaimer, the term of this patent is extended or adjusted under 35 U.S.C. 154(b) by 164 days.

(21) Appl. No.: 13/696,759

(22) PCT Filed: Mar. 22, 2011

(86) PCT No.: PCT/JP2011/056704

§ 371 (c)(1),
(2), (4) Date: Nov. 7, 2012

(87) PCT Pub. No.: WO2011/142177

PCT Pub. Date: Nov. 17, 2011

(65) Prior Publication Data

US 2013/0078892 A1 Mar. 28, 2013

(30) Foreign Application Priority Data

May 10, 2010 (JP) ..... 2010-108506

(51) Int. Cl.

| | |
|---|---|
| ***B24D 11/00*** | (2006.01) |
| ***B24B 37/24*** | (2012.01) |
| ***B24B 7/24*** | (2006.01) |

(52) U.S. Cl.

CPC ..... *B24D 11/00* (2013.01); *B24B 37/24* (2013.01); *B24B 7/241* (2013.01)

USPC ..... 451/41; 451/533

(58) Field of Classification Search

USPC ..... 451/41, 526, 527, 533, 534, 538; 51/293, 298

See application file for complete search history.

(56) References Cited

U.S. PATENT DOCUMENTS

| | | | |
|---|---|---|---|
| 6,454,634 | B1 | 9/2002 | James et al. |
| 6,736,709 | B1 | 5/2004 | James et al. |
| 6,749,485 | B1 | 6/2004 | James et al. |
| 6,860,802 | B1 | 3/2005 | Vishwanathan et al. |

(Continued)

FOREIGN PATENT DOCUMENTS

| | | |
|---|---|---|
| JP | 2004-507076 | 3/2004 |
| JP | 2006-114885 | 4/2006 |

(Continued)

OTHER PUBLICATIONS

International Search Report mailed May 17, 2011, directed towards International Application No. PCT/JP2011/056704; 2 pages.

*Primary Examiner* — Robert Rose
(74) *Attorney, Agent, or Firm* — Morrison & Foerster LLP

(57) ABSTRACT

A polishing pad having a polishing layer comprising a thermoset polyurethane foam, wherein about the thermoset polyurethane foam, the Asker C hardness value thereof is 82 or less as a 60-second value, the hardness value being a value after the foam is immersed in water for 24 hours, and further the value of the tensile storage modulus E' (30° C.) thereof at a frequency of 1.6 Hz satisfies the following expression (1):

$$Y<5X-150 \quad (1)$$

wherein Y represents the tensile storage modulus E' (MPa), and X represents the Asker C hardness value (60-second value) after the foam is immersed in water for 24 hours.

6 Claims, 2 Drawing Sheets

(56) References Cited

U.S. PATENT DOCUMENTS

| | | | | |
|---|---|---|---|---|
| 7,192,340 | B2 * | 3/2007 | Ono et al. | 451/526 |
| 7,195,539 | B2 * | 3/2007 | Turner et al. | 451/6 |
| 7,762,870 | B2 * | 7/2010 | Ono et al. | 451/28 |
| 7,871,309 | B2 * | 1/2011 | Ogawa et al. | 451/41 |
| 2003/0027500 | A1 | 2/2003 | James et al. | |
| 2005/0020082 | A1 | 1/2005 | Vishwanathan et al. | |
| 2006/0060569 | A1 | 3/2006 | Tano et al. | |
| 2010/0029185 | A1 | 2/2010 | Fukuda et al. | |
| 2011/0183579 | A1 * | 7/2011 | Newelll | 451/28 |

FOREIGN PATENT DOCUMENTS

| | | |
|---|---|---|
| JP | 2009-214275 | 9/2009 |
| JP | 2009-291854 | 12/2009 |
| WO | WO-2008/087797 | 7/2008 |

* cited by examiner

POLISHING PAD, PRODUCTION METHOD FOR SAME, AND PRODUCTION METHOD FOR GLASS SUBSTRATE

REFERENCE TO RELATED APPLICATIONS

This application is a national stage application under 35 USC 371 of International Application No. PCT/JP2011/056704, filed Mar. 22, 2011, which claims the priority of Japanese Patent Application No. 2010-108506, filed May 10, 2010, the entire contents of which are incorporated herein by reference.

FIELD OF THE INVENTION

The present invention relates to a polishing pad (for rough polishing and finish polishing) used at the time of polishing a surface of a matter to be polished, for example, an optical matter such as a lens and a reflecting mirror, a silicon wafer, a glass substrate for a hard disc, or an aluminium substrate. The polishing pad of the present invention is used, particularly, as a polishing pad for polishing a glass substrate roughly.

BACKGROUND OF THE INVENTION

In general, the mirror polishing of a semiconductor wafer such as a silicon wafer, a lens, a glass substrate, or some other matter to be polished is divided to rough polishing for a main purpose of adjusting the polished matter in flatness and in-plane evenness, and finish polishing for a main purpose of improving the matter in surface roughness, and removing scratches. In general, polishing characteristics required at the time of the rough polishing are largely different from ones required at the time of the finish polishing, as described above. It is therefore necessary to distinguish a polishing pad for rough polishing, and one for finish polishing from each other in the use thereof.

As a polishing pad used for rough polishing, suggested are pads as described below.

For example, Patent Document 1 listed up below suggests a polishing pad having a value of about 1 to 3.6 as the ratio between the E' thereof at 30° C. and the E' at 90° C. Patent Document 2 listed up below also suggests a chemical mechanical polishing pad including a polishing substrate having a value of 120 MPa or less as the storage modulus E' (30° C.) at 30° C., and having a value of 2.5 or more as the ratio of the storage modulus E' (30° C.) at 30° C. to the storage modulus E' (60° C.) at 60° C. (E'(30° C.)/E'(60° C.)).

The polishing pads described in these patent documents are each very hard. Thus, when these are each used as a pad for rough polishing, a matter to be polished is made substantially flat at an edge region thereof as well as a central or the inner region thereof. However, the matter is low in work precision so that the matter is required to be again polished with a finishing pad. However, when the matter to be polished, which is in a substantially flat format the edge region as well as the central region, is polished with a polishing pad for finish polishing, a large pushing pressure is applied to the edge region of the matter so that the polish quantity at the edge region becomes larger than that of the central region. As a result, there remains a problem that an excessively polished phenomenon of the edge region, which is called "edge-subsidence", is caused.

Patent Document 1: JP-W-2004-507076 (i.e., JP-A-2004-507076 according to the JPO)

Patent Document 2: JP-A-2006-114885

SUMMARY OF THE INVENTION

In light of the above-mentioned actual situation, an object thereof is to provide a polishing pad capable of making an edge region of a matter to be polished, after the matter is roughly polished, into an upheaved form, thereby making it possible to flatten the matter at the edge region as well as an inner or central region thereof after the matter is finish-polished; and a method for producing a glass substrate, using the polishing pad.

In order to solve the above-described problems, the present inventors have made eager investigations about the relationship between the form of an edge region of a matter to be polished after the matter is roughly polished, and that of the edge region of the matter after the matter is finish-polished. As a result, the present inventors have found out that the edge region of the matter to be polished after the rough polishing is made into the form of being larger in thickness than a central region thereof, the so-called "upheaved form", thereby making it possible to flatten the matter after the finish polishing at the edge region as well as the inner or central region.

On the basis of the above-described investigations, the present invention has been made, and the above-mentioned object is attained by the following:

Accordingly, the polishing pad of the present invention is a polishing pad having a polishing layer comprising a thermoset polyurethane foam, wherein about the thermoset polyurethane foam, the Asker C hardness value thereof is 82 or less as a 60-second value, the hardness value being a value after the foam is immersed in water for 24 hours, and further the value of the tensile storage modulus E' (30° C.) thereof at a frequency of 1.6 Hz satisfies the following expression (1):

$$Y<5X-150 \quad (1)$$

wherein Y represents the tensile storage modulus E' (MPa), and X represents the Asker C hardness value (60-second value) after the foam is immersed in water for 24 hours.

In the polishing pad of the present invention, about the thermoset polyurethane foam, the Asker C hardness value is set to 82 or less as a 60-second value, the hardness value being a value after the foam is immersed in water for 24 hours, and further the Asker C hardness value and the tensile storage modulus are adjusted to satisfy the relationship shown by the expression (1). Therefore, when this polishing pad is used, in particular, for rough polishing of a matter to be polished, an edge region of the matter is made into an upheaved form after the rough polishing. When the matter to be polished, the edge of which is in the upheaved form, is finish-polished, using a polishing pad for finish polishing, it is possible to flatten the whole of the surface of the matter, which includes the edge region thereof. Unclear is the reason why when the polishing pad of the present invention is used, in particular, for rough polishing, the edge region of the matter after the rough polishing is made into the upheaved form; however, the reason would be the following reason.

In the case of using a polishing pad high in hardness as a polishing pad for rough polishing, a matter to be polished tends to be made substantially flat at an edge region thereof as well as an inner or central region thereof. However, in the case of making a polishing pad appropriately soft, specifically, setting the Asker C hardness value thereof at a 60-second value to 82 or less, the value being a value after the pad is immersed in water for 24 hours, while the Asker C hardness value and the tensile storage modulus are adjusted to have the relationship shown by the expression (1), the following is caused when a matter to be polished is polished: the polishing pad is easily deformed in the tensile direction, so that the pushing pressure at an edge region of the matter is declined. Thus, at the edge region of the matter, a portion where the polishing rate is low is generated. As a result, the edge region of the matter becomes smaller in polish quantity than the central region. This matter would make the edge region into the upheaved form.

In the above-mentioned polishing pad, it is preferred that the thermoset polyurethane foam comprises, as raw material components, an isocyanate component, and active-hydrogen-containing compounds comprising 5 to 20% by weight of a polyol compound having a functional group number of 2 and a hydroxyl group value of 1,100 to 1,400 mg KOH/g, and 10 to 40% by weight of a polyol compound having a functional group number of 3 and a hydroxyl group value of 200 to 600 mg KOH/g. When this blend composition is used for raw material components to form the thermoset polyurethane foam, it is possible to set the Asker C hardness value thereof at a 60-second value to 82 or less, the value being a value after the pad is immersed in water for 24 hours, while the Asker C hardness value and the tensile storage modulus are certainly adjusted to satisfy the relationship shown by the expression (1). As a result, the edge region of the matter after the matter is roughly polished can be certainly into an upheaved form.

In the polishing pad, it is preferred that about the thermoset polyurethane foam, the Asker C hardness value thereof, as the 60-second value, is 75 or less, the hardness value being a value after the foam is immersed in water for 24 hours. It is more preferred that the value of the tensile storage modulus E' (30° C.) at the frequency of 1.6 Hz is 100 MPa or less. When the Asker C hardness value or the tensile storage modulus E' (30° C.) of the thermoset polyurethane foam is adjusted to this range, the edge region of the matter after the matter is roughly polished can be made into an upheaved form with higher certainty.

In the polishing pad, it is preferred that the thermoset polyurethane foam has substantially spherical continuous bubbles having an average bubble diameter of 20 to 300. When the polishing layer is formed by use of the thermoset polyurethane foam, which has substantially spherical continuous bubbles having an average bubble diameter of 20 to 300 μm, the polishing layer can be improved in endurance. Thus, when the polishing pad of the present invention is used, the polishing pad can keep high planarization characteristics over a long term, and is also improved in polishing rate stability. The wording "substantially spherical" denotes a spherical form and an elliptic form. Bubbles in an elliptic form denote bubbles having a ratio between the long diameter L and the short diameter S (ratio of L/S) of 5 or less, preferably 3 or less, more preferably 1.5 or less.

Furthermore, the present invention relates to a method for producing a glass substrate, comprising the step of using the polishing pad recited in any one of the above-described paragraphs concerned to polish a glass substrate surface. A glass-substrate-producing method generally includes a rough polishing step for a main purpose of adjusting the substrate in flatness and in-plane evenness, and a finish polishing step for a main purpose of improving the substrate in surface roughness, and removing scratches; by using, in this rough polishing step, the polishing pad according to the present invention, a glass substrate can be produced which has an excellent flatness at not only a central region thereof but also an edge region thereof.

DETAILED DESCRIPTION OF THE INVENTION

Figure 1:
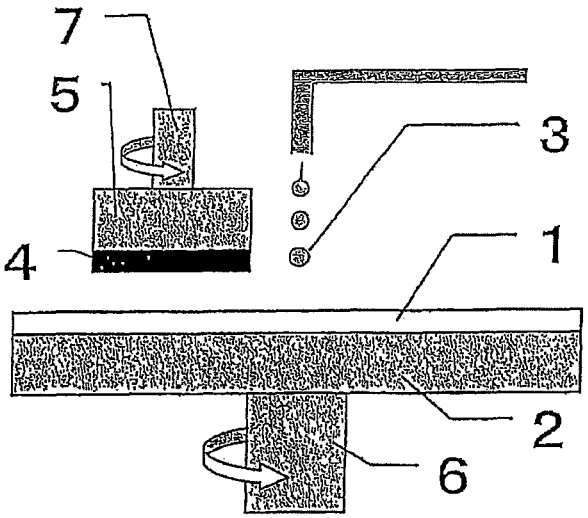
FIG. 1 is a schematic structural view illustrating an example of a polishing apparatus used in a method for producing a glass substrate.

The polishing pad of the present invention has a polishing layer made of a thermoset polyurethane foam, which may be referred to as a "polyurethane foam" hereinafter.

Polyurethane resin is excellent in abrasion resistance, and can be a polymer that can easily obtained with various physical properties by changing the composition of raw materials thereof variously; and further therein, substantially spherical fine bubbles can easily be formed by a mechanical foaming method (examples thereof including a mechanical frothing method). For these reasons, polyurethane resin is a material particularly preferable for the constituting material of the polishing layer.

Polyurethane resin mainly contains an isocyanate component, and active-hydrogen-containing compounds (such as a high-molecular-weight polyol, a low-molecular-weight polyol, a low-molecular-weight polyamine and a chain extender).

As the isocyanate component, any compound known in the field of polyurethane may be used without especial restriction. Examples thereof include aromatic diisocyanates such as 2,4-toluene diisocyanate, 2,6-toluene diisocyanate, 2,2'-diphenylmethane diisocyanate, 2,4'-diphenylmethane diisocyanate, 4,4'-diphenylmethane diisocyanate, polymeric MDI, carbodiimide-modified MDI (for example, MILLIONATE MTL (trade name) manufactured by Nippon Polyurethane Industry Co., Ltd.), 1,5-naphthalene diisocyanate, p-phenylene diisocyanate, m-phenylene diisocyanate, p-xylylene diisocyanate, and m-xylylene diisocyanate; aliphatic diisocyanates such as ethylene diisocyanate, 2,2,4-trimethylhexamethylene diisocyanate, and 1,6-hexamethylene diisocyanate; and alicyclic diisocyanates such as 1,4-cyclohexane diisocyanate, 4,4'-dicyclohexylmethane diisocyanate, isophorone diisocyanate, and norbornane diisocyanate. These may be used alone or in combination of two or more thereof.

It is preferred to use, out of the above-described isocyanate components, an aromatic diisocyanate, in particular, at least one of toluene diisocyanate, diphenylmethane diisocyanate, and carbodiimide-modified diphenylmethane diisocyanate.

The active-hydrogen-containing compounds may each be an active-hydrogen-containing compound used ordinarily in technique fields of polyurethane, such as a high-molecular-weight polyol, a low-molecular-weight polyol, a low-molecular-weight polyamine or a chain extender.

Examples of the high-molecular-weight polyol include any polyether polyol, a typical example thereof being polytetramethylene ether glycol; any polyester polyol, a typical example thereof being polybutylene adipate; any polyester polycarbonate polyol, examples thereof including polycaprolactone polyol, and a reaction material made from a polyester glycol, such as polycaprolactone, and an alkylene carbonate; any polyester polycarbonate polyol yielded by causing ethylene carbonate to react with a polyhydric alcohol, and next causing the resultant reaction mixture to react with an organic dicarboxylic acid; any polycarbonate polyol yielded by transesterification reaction between a polyhydroxy compound and an aryl carbonate; and any polymer polyol that is a polyether polyol wherein polymer particles are dispersed. These may be used alone or in combination of two or more thereof.

Examples of the low-molecular-weight polyol include trimethylolpropane, glycerin, diglycerin, 1,2,6-hexanetriol, triethanolamine, pentaerythritol, tetramethylolcyclohexane, and methylglucoside; and alkylene oxide (such as EO or PO) adducts of these examples. These may be used alone or in combination of two or more thereof.

Examples of the low-molecular-weight polyamine include ethylenediamine, tolylenediamine, and diphenylmethanediamine; and alkylene oxide (such as EO or PO) adducts of these examples. These may be used alone or in combination of two or more thereof.

It is allowable to use the following together: for example, one or more low-molecular-weight polyols, such as ethylene glycol, 1,2-propylene glycol, 1,3-propylene glycol, 1,2-butanediol, 1,3-butanediol, 1,4-butanediol, 2,3-butanediol, 1,6-hexanediol, neopentylglycol, 1,4-cyclohexanedimethanol, 3-methyl-1,5-pentanediol, diethylene glycol, and triethylene glycol; and one or more alcoholamines, such as monoethanolamine, diethanolamine, 2-(2-aminoethylamino)ethanol, and monopropanolamine.

The chain extender is an organic compound having at least two active hydrogen groups. Examples of the active hydrogen groups include hydroxyl groups, primary or secondary amino groups, and thiol groups (SH). Specific examples of the chain extender include 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, 1,2-bis(2-aminophenylthio)ethane, 4,4'-diamino-3,3'-diethyl-5,5'-dimethyldiphenylmethane, N,N'-di-sec-butyl-4,4'-diaminodiphenylmethane, 3,3'-diethyl-4,4'-diaminodiphenylmethane, m-xylylenediamine, N,N'-di-sec-butyl-p-phenylenediamine, m-phenylenediamine, p-xylylenediamine, and other polyamines; and the above-mentioned low-molecular-weight polyols or low-molecular-weight polyamines. These may be used alone or in combination of two or more thereof.

It is allowable to use the following as an additive together: for example, diethylene glycol monoethyl ether, diethylene glycol monomethyl ether, dipropylene glycol monoethyl ether, dipropylene glycol monomethyl ether, 2-methoxyethanol, ethylene glycol monoethyl ether, ethylene glycol monobutyl ether, ethylene glycol mono-t-butyl ether, ethylene glycol monophenyl ether, diethylene glycol monobutyl ether, triethylene glycol monobutyl ether or polyethylene glycol mono-p-isooctylphenyl ether; any alkylene oxide adduct of a carboxylic acid such as acetic acid, acrylic acid or methacrylic acid, or any other monool compound; or polyethylene glycol.

The polyurethane foam related to the present invention preferably contains, as raw material components, an isocyanate component, and active-hydrogen-containing compounds comprising 5 to 20% by weight of a polyol compound having a functional group number of 2 and a hydroxyl group value of 1,100 to 1,400 mg KOH/g, and 10 to 40% by weight of a polyol compound having a functional group number of 3 and a hydroxyl group value of 200 to 600 mg KOH/g. When this blend composition is used for the raw material components to form a thermoset polyurethane foam, an edge region of a matter to be polished can be certainly made into an upheaved form after the matter is roughly polished.

The ratio between the isocyanate component and the active-hydrogen-containing compounds may be variously changed in accordance with the molecular weight of each of these materials, desired physical properties of the polyurethane foam, and others. In order to give a foam having desired properties, the following index is preferably from 0.80 to 1.20, more preferably from 0.90 to 1.15: the number (NCO index) of isocyanate groups of the isocyanate component relative to the number of entire active hydrogen groups (hydroxyl groups+amino groups) of the active-hydrogen-containing compounds. If the number of the isocyanate groups is out of this range, the resultant polyurethane tends to undergo curing insufficiency not to gain a required specific gravity, hardness, compressibility nor some other property.

The polyurethane resin may be produced by a known urethanizing technique such as melting technique or solution technique. When cost, working environment and others are considered, it is preferred to produce the resin by melting technique. For the production of the polyurethane resin, either a prepolymer method or a one-shot method may be used.

The thermoset polyurethane foam, which is a material for forming the polishing layer, is produced by a mechanical foaming method (examples thereof including a mechanical frothing method).

Particularly preferred is a mechanical foaming method using a silicone surfactant that is a copolymer of a polyalkylsiloxane and a polyether. Examples of a preferred compound as the silicone surfactant include SH-192 and L-5340 (manufactured by Dow Corning Toray silicone Co., Ltd.), and B8443 (manufactured by Goldschmidt GmbH) and B8465 (manufactured by Goldschmidt GmbH).

If necessary, the following may be added (to the resin): a stabilizer such as an antioxidant, a lubricant, a pigment, a filler, an antistatic agent, and other additives.

A description will be made hereinafter about examples of a method for producing the thermoset polyurethane foam constituting the polishing layer. This polyurethane foam producing method has the following steps:

(1) An isocyanate component, polyol compounds and others are caused to react with each other to prepare an isocyanate-terminated prepolymer. A silicone surfactant is added to the prepolymer to produce a first component. While the first component is mechanically stirred in the presence of a nonreactive gas, the nonreactive gas is dispersed thereinto as fine bubbles to prepare a foam-dispersed liquid. To the foam-dispersed liquid is added a second component including active-hydrogen-containing compounds such as a low-molecular-weight polyol and a low-molecular-weight polyamine, and then these components are mixed with each other to prepare a foam-dispersed urethane composition. A catalyst may be appropriately added to the second component.

(2) A silicone surfactant is added to at least one of a first component including an isocyanate component (or isocyanate-terminated prepolymer), and a second component including active-hydrogen-containing compounds, and then the component to which the silicone surfactant is added is mechanically stirred in the presence of a nonreactive gas to disperse the nonreactive gas thereinto as fine bubbles. In this way, a foam-dispersed liquid is prepared. The remnant component is added to the foam-dispersed liquid. The components therein are mixed with each other to prepare a foam-dispersed urethane composition.

(3) A silicone surfactant is added to at least one of a first component including an isocyanate component (or isocyanate-terminated prepolymer), and a second component including active-hydrogen-containing compounds, and then the first and second components are mechanically stirred in the presence of a nonreactive gas to disperse the nonreactive gas thereinto as fine bubbles to prepare a foam-dispersed urethane composition.

The foam-dispersed urethane composition may be prepared by a mechanical frothing method. The mechanical frothing method is a method of: putting raw material components into a mixing chamber of a mixing head while a nonreactive gas is incorporated thereinto; and mixing and stirring the components by means of a mixer such as an Oakes mixer, thereby making the nonreactive gas into the state of fine bubbles and further dispersing the bubbles into the raw material mixture. The mechanical frothing method is a preferred method since the method makes it possible to adjust the density of the polyurethane foam easily by the adjustment of the incorporated amount of the nonreactive gas. Moreover, the method gives a good production-efficiency since the method makes it possible to shape continuously a polyurethane foam having substantially spherical fine bubbles having an average bubble diameter of 20 to 300 μm.

Thereafter, the foam-dispersed urethane composition prepared by this method is painted onto a planar member, and then the foam-dispersed urethane composition is cured to form a thermoset polyurethane foam (polishing layer) directly onto the planar member.

The nonreactive gas used to form the fine bubbles is preferably an incombustible gas, and specific examples thereof include nitrogen, oxygen and carbon dioxide gases, rare gases such as helium and argon, and any mixed gas of two or more of these gases. The gas from which water is removed by drying is most preferred from the viewpoint of costs.

As a stirring machine for making the nonreactive gas in the form of fine bubbles, and further dispersing the bubbles, a known stirring machine may be used without especial restriction. Specific examples of the machine include a homogenizer, a Dissolver, a biaxial planetary mixer, and a mechanical frothing machine. The shape of one or more stirring vanes of the stirring machine is not particularly limited. A whipper-shaped stirring vane is preferred since the use thereof gives fine bubbles.

It is also preferred to use different stirring machines for the stirring for preparing the foam-dispersed liquid in the forming step, and for the stirring for mixing the first and second components to each other. In the mixing step, the stirring is not required to be stirring for forming bubbles, and the use of a stirring machine that does not generate large bubbles is preferred. Such a stirring machine is preferably a planetary mixer. Even when the same stirring machine is used in the foaming step of preparing the foam-dispersed liquid and the mixing step of mixing the individual components with each other, no problem is caused. It is also preferred to use the machine while stirring conditions are adjusted, for example, the rotating speed of the stirring vane(s) is adjusted as the need arises.

In the polishing pad according to the present invention, a substrate layer may be laminated on the polishing layer. When the substrate layer is laminated on the polishing layer, the substrate layer is not particularly limited. Examples thereof include nylon, polypropylene, polyethylene, polyester, polyvinyl chloride, and other plastic films; a polyurethane foam, a polyethylene foam, and other high-molecular-weight resin foams; rubbery resins such as butadiene rubber and isoprene rubber; and photosensitive resins. It is preferred to use, out of these examples, nylon, polypropylene, polyethylene, polyester, polyvinyl chloride, and other plastic films; and polyurethane foam, polyethylene foam, and other high-molecular-weight resin foams. The substrate layer may be a double-sided tape, or a single-sided adhesive tape (the single-sided adhesive layer thereof is to be bonded to a platen).

The substrate layer preferably has a hardness equal to or more than that of the polyurethane foam to give toughness to the polishing pad. The thickness of the substrate layer (when the layer is a double-sided tape or a single-sided adhesive tape, the thickness of its substrate) is not particularly limited, and is preferably from 20 to 1,000 μm, more preferably from 50 to 800 μm from the viewpoint of strength and flexibility.

Examples of the means that can be adopted to paint the foam-dispersed urethane composition onto the planar member include gravure, kiss and comma and other roll coaters; slot, fountain and other die coaters; a squeeze coater; a curtain coater; and other painting means. However, the means may be any means capable of forming a uniform painted film on the substrate member.

It is highly preferable to heat the polyurethane foam obtained by painting the foam-dispersed urethane composition onto the planar member and causing the components to react with each other until the composition comes not to flow, thereby post-curing the composition since the post-curing produces an effect of improving the polyurethane foam in physical properties. The post-curing is preferably performed at 40 to 70° C. for 10 minutes to 24 hours, and this operation is also preferably performed under a normal pressure since the shape of the bubbles is stabilized.

In the production of the polyurethane foam, a tertiary amine catalyst, or any other known catalyst may be used for promoting the polyurethane reaction. The kind and the addition amount of the catalyst is selected, considering a period when a mixture yielded after the step of mixing the individual components with each other is flowing in order to be painted onto the planar member.

The polyurethane foam may be produced in a batch manner of weighing the individual components, charging the components into a container and then stirring the components mechanically, or in a continuous production manner of supplying the individual components and the nonreactive gas continuously to a stirring machine, stirring these components mechanically, feeding out the foam-dispersed urethane composition and then shaping the composition into a shaped product.

In the polishing pad manufacturing method of the present invention, it is necessary that after or while a polyurethane foam is formed onto a planar member, the polyurethane foam is adjusted into a uniform thickness. The method for adjusting the polyurethane foam into a uniform thickness is not particularly limited, and examples thereof include a method of buffing the foam with a polishing member, and a method of pressing the foam by use of a pressing plate. When the foam is buffed, a polishing layer having, on the polyurethane foam surface, no skin layer is yielded. When the foam is pressed, a polishing layer having, on the polyurethane foam surface, a skin layer is yielded. Conditions for the pressing are not particularly limited; preferably, the temperature of the foam is adjusted to the glass transition point or higher.

The foam-dispersed urethane composition prepared in the above-mentioned manner is painted onto a releasing sheet, and a substrate layer is laminated onto the foam-dispersed urethane composition. Thereafter, by curing the foam-dispersed urethane composition while a pressing means is used to make the composition into a uniform thickness, a polyurethane foam may be formed. This method is a particularly preferred method since the polishing layer can be controlled into a highly uniform thickness.

The material for forming the releasing sheet is not particularly limited, and examples thereof may be the same resins and papers for the above-mentioned substrate. The releasing sheet is preferably a sheet small in dimension change based on heat. The surface of the releasing layer may be subjected to releasing treatment.

The pressing means for making, into a uniform thickness, the sandwich sheet composed of the releasing sheet, the foam-dispersed urethane composition (foam-dispersed urethane layer) and the substrate layer is not particularly limited. For example, a coater roller, a nip roller or some other is used to compress the sandwich sheet into a constant thickness. Considering that after the compressing, the size of the bubbles in the foamed layer becomes about 1.2 to 2 times larger than that before the compressing, it is preferred at the compressing time to make "50 to 85% of the thickness of the cured polyurethane foam" equal to a value of "the clearance of the coater or the nip"–"the thickness of the substrate layer and the releasing sheet". In order to yield a polyurethane foam having a specific gravity of 0.2 to 0.5, it is preferred that the foam-dispersed urethane composition has a specific gravity of 0.24 to 1 before passed through the roll.

After the sandwich sheet is made into the uniform thickness, the polyurethane foam obtained by causing the components concerned to react with each other until the foam comes not to flow is heated to be post-cured. Conditions for the post-curing are the same as described above.

Thereafter, the releasing sheet underneath the polyurethane foam is peeled. In this case, a skin layer is being formed on the polyurethane foam. When the polyurethane foam is formed by a mechanical foaming method as described above, the unevenness of the bubbles is less generated in the upper surface side of the polyurethane foam than in the lower surface side. When the lower surface side of the thus-formed polyurethane foam is used as a polishing surface, this polishing surface is a surface wherein the unevenness of the bubbles is small. Thus, the polishing pad is made better in polishing rate stability. The skin layer may be removed by buffing the polyurethane foam after the releasing sheet is peeled.

The thickness of the polyurethane foam is not particularly limited, and is preferably from 0.2 to 3 mm, more preferably from 0.5 to 2 mm.

The polyurethane foam produced by the above-mentioned production method has substantially spherical bubbles. The polyurethane foam according to the present invention may be a foam having continuous bubbles, or a foam having independent bubbles.

The average bubble diameter of the bubbles in the polyurethane foam is from 20 to 300 μm, preferably from 50 to 100 μm. When the bubbles are continuous bubbles, the average diameter of circular openings in the surfaces of the bubbles is preferably 100 μm or less, more preferably 50 μm or less.

The specific gravity of the polyurethane foam is preferably from 0.3 to 0.65, more preferably from 0.3 to 0.5. If the specific gravity is less than 0.3, the polishing layer or pad tends to be too high in porosity so as to be deteriorated in endurance. On the other hand, if the specific gravity is more than 0.65, it is necessary to make the raw materials into a low crosslinkage density in order to make the polishing layer into a predetermined elastic modulus. In this case, the polishing pad tends to be increased in permanent strain to be deteriorated in endurance.

In the present invention, it is essential and important that about the polyurethane foam, which forms the polishing layer, the Asker C hardness value thereof is 82 or less, preferably 75 or less as a 60-second value, the hardness value being a value after the foam is immersed in water for 24 hours. If the Asker C hardness value is more than 82, an edge region of a matter to be polished after the matter is roughly polished cannot be made into an upheaved form.

In the present invention, the polyurethane foam, which forms the polishing layer, the tensile storage modulus E' (30° C.) at a frequency of 1.6 Hz satisfies the following expression (1):

$$Y<5X-150 \quad (1)$$

wherein Y represents the tensile storage modulus E' (MPa), and X represents the Asker C hardness value (60-second value) after the foam is immersed in water for 24 hours. The value of the tensile storage modulus E' is preferably 100 MPa or less. If about the polyurethane foam, which forms the polishing layer, the value of the tensile storage modulus E' (30° C.) at the frequency of 1.6 Hz does not satisfy the expression (1), an edge region of a matter to be polished after the matter is roughly polished cannot be made into an upheaved form.

The shape of the polishing pad of the present invention is not particularly limited, and may be a long strip shape having a length of about 5 to 10 m, or may be a round shape having a diameter of about 50 to 150 cm.

The front surface of the polishing layer may have a convexo-concave structure for hold/renewing a slurry. The polishing layer made of the foam has many openings at its polishing surface to have a function of holding/renewing a slurry, and when the convexo-concave structure is formed in the polishing surface, the holding and renewing of a slurry can be more effectively attained. Moreover, the structure makes it possible to prevent a matter to be polished from being broken by adsorption between the pad and the matter to be polished. The form of the convexo-concave structure is not particularly limited as far as the form holds/renews a slurry. Examples of the convexo-concave structure include X (stripe) grooves, XY lattice grooves, concentric grooves, through holes, blind holes, polygonal columns, circular columns, a spiral groove, eccentric grooves, radial grooves, and any combination of two or more of these grooves. These convexo-concave structures each generally have therein regularity. However, in order to render the structure a structure having a desired performance of holding/renewing a slurry, the structure may be changed in groove pith, groove width, groove depth or some other inside individual areas thereof.

The method for forming the convexo-concave structure is not particularly limited, and examples thereof include a method of using a tool, such as a bite having a predetermined size, to cut the polishing layer mechanically, a method of causing a resin to flow in a mold having a predetermined surface shape, and curing the resin to form the structure, a method of pressing a resin by use of a pressing plate having a predetermined surface shape to form the structure, a method of using photolithography to form the structure, a method of using a printing method to form the structure, and a method of using a laser ray, such as a carbon dioxide gas laser ray, to form the structure.

The polishing pad of the present invention may be a pad wherein a cushion sheet is bonded onto a non-polishing surface side of a polishing layer. When a substrate layer is laminated onto the polishing layer, it is preferred to laminate the polishing layer, the substrate layer, and the cushion sheet in this order.

The cushion sheet (cushion layer) is a member compensating for properties of the polishing layer. The cushion sheet is required in order to make both of planarity and uniformity, which have a tradeoff relationship with each other in chemical mechanical polishing, compatible with each other. The planarity is the following flatness at the time of polishing a matter to be polished which has fine irregularities generated when a pattern is formed in the matter: the flatness of the patterned region. The uniformity is the evenness of the whole of the matter to be polished. In accordance with properties of the polishing layer, the planarity is improved, and in accordance with properties of the cushion sheet, the uniformity is improved. In the polishing pad of the present invention, it is preferred to use, as the cushion sheet, a sheet softer than the polishing layer.

Examples of the cushion sheet include fiber nonwoven fabrics, such as a polyester nonwoven fabric, a nylon nonwoven fabric, and an acrylic nonwoven fabric; resin-impregnated nonwoven fabrics, such as a polyester nonwoven fabric into which polyurethane is impregnated; high-molecular-weight resin foams, such as a polyurethane foam, and a polyethylene foam; and rubbery resins, such as butadiene rubber and isoprene rubber; and photosensitive resins.

The means for bonding the cushion sheet is, for example, a means of sandwiching the polishing layer and the cushion layer between pieces of a double-sided tape, and then pressing the sandwich.

In the polishing pad of the present invention, a double-sided tape may be laid on the surface thereof which is to be bonded to a platen.

The glass substrate is produced through steps of using the above-mentioned polishing pad to polish the front surface of the glass substrate, in particular, through a rough polishing step and a finish polishing step thereof. The method and machine for polishing the glass substrate are not particularly limited. For example, as illustrated in FIG. 1, the polishing is performed by use of a polishing machine equipped with a polishing table 2 for supporting a polishing pad 1, a supporter (polishing head) 5 for supporting a glass substrate 4, a backing member for applying an even pressure to the wafer, and a mechanism for supplying a polishing agent 3. The polishing pad 1 is bonded onto the polishing table 2 through, for example, a double-sided tape to be fitted on the table 2. The polishing table 2 and the supporter 5 are arranged in such a manner that the polishing pad 1 and the glass substrate 4 supported on these members 2 and 5, respectively, are faced to each other. The members 2 and 5 have rotating axes 6 and 7, respectively. In the vicinity of the supporter 5, a pressing mechanism is located for pushing the glass substrate 4 onto the polishing pad 1. The glass substrate 4 is polished by pushing the glass substrate 4 onto the polishing pad 1 while the polishing table 2 and the supporters are rotated, and further supplying a slurry thereto. The flow rate of the slurry is not particularly limited, as well as the load for the polishing, the rotation number of the polishing table, and the rotation number of the wafer. These are appropriately adjusted.

Through the rough polishing step for the glass substrate 4, an edge region of the glass substrate 4 is made into an upheaved form. Furthermore, the glass substrate is subjected to a finish polishing step for a main purpose of improving the substrate in surface roughness and removing scratches to produce the glass substrate 4 into a substrate having an excellent flatness at an edge region thereof as well as a central region thereof. The glass substrate produced by use of the polishing pad according to the present invention is excellent in flatness; thus, the pad is useful as a lens, or a glass substrate for a hard disc.

EXAMPLES

Hereinafter, the present invention will be described by way of working examples. However, the present invention is not limited to these working examples.

Upheaved Form Measuring Measurement:

A noncontact profilometer (New View 6300, manufactured by Zygo Corp.) is used to measure an outer circumferential region of a glass substrate (region extending from 0.9 to 4.5 mm apart from the edge of the glass substrate) under conditions that the lens power is 2.5, and the zooming power is 0.5. Points 0.9 mm, 3.5 mm and 4.5 mm apart from the edge of the glass are named points A, B and C, respectively. An extended line through which the points B and C are joined with each other is used as a standard line. A point inside the measured region where the distance between any straight line in the thickness direction of the glass substrate and the standard line is maximum is defined as a measuring point. This distance is defined as the Dub Off (nm). In the case of any edge-region upheaved form, this value is positive.

Measurement of Polishing Rate:

A double-sided polisher (9B type double-sided polisher, manufactured by SpeedFam Co., Ltd.) is used as a polishing apparatus to measure the polishing rate of a produced polishing pad. Conditions for the polishing are as follows:

Processing pressure: 100 g/cm$^2$

Table rotation number: 50 rpm

Polishing agent: SHOROX A-10 (ceria abrasive grains: manufactured by Showa Denko K.K.)

Slurry specific gravity: 1.06 to 1.09 (mixture of water and the polishing agent)

Slurry supply rate: 4 L/min

Charged substrates: TS-10SX, manufactured by Ohara Inc.

The number of the charged glass substrates: 25

The method for calculating out the polishing rate is as follows:

Polishing rate (Å/min)=["quantity [g] of a change in the weight of each glass plate before and after it is polished"/("glass plate density [g/cm$^3$]"×"polished-glass-plate area [cm$^2$]"×"polishing period [min]")]×108

Tiny Undulations:

A noncontact profilometer (New View 6300, manufactured by Zygo Corp.) is used to measure the Ra of each of five points of the front surface of a matter to be polished under conditions that the lens power is 2.5, the zooming power is 0.5, and its bandpass filter is set to 200 to 1,250 μm. The average value (nm) thereof is defined as the tiny undulations.

Specific Gravity Measurement:

The measurement is made in accordance with JIS Z8807-1976. Any produced polyurethane foam is cut out into the form of a strip (thickness: selected at will) 4 cm×8.5 cm in size, and the strip is used as a sample. The sample is allowed to stand still in an environment having a temperature of 23° C.±2° C., and a humidity of 50±5% for 16 hours. The measurement is made by use of a gravimeter (manufactured by Sartorius AG). In this way, the specific gravity is measured.

Asker C hardness value (60-second value) after immersion for 24 hours:

A measurement thereof is made in accordance with JIS K-7312. A produced polyurethane foam is cut into pieces having a size of 5 cm×5 cm, and the cut pieces are used as samples. The samples are immersed in water of 22±2° C. temperature, and then taken out. The samples are measured in an environment having a temperature of 22±2° C., and a humidity of 65±5%. At the measurement time, some of the samples are put onto each other into a thickness of 10 mm or more. A hardness meter (Asker C hardness meter, manufactured by Kobunshi Keiki Co., Ltd., pressing surface height: 3 mm) is used, and the pressing surface is brought into contact therewith. After 60 seconds from the contact, the hardness is measured.

Tensile Storage Modulus E':

A dynamic viscoelasticity measuring device (DMA861a, manufactured by Mettler-Toledo International Inc.) is used to make a measurement. Conditions for the measurement are as follows:

Frequency: 1.6 Hz

Temperature-raising rate: 2.0° C./min

Measuring temperature range: 0 to 90° C.

Sample form: 19.5 mm (height)×3.0 mm (width)×1.0 mm (thickness)

Raw Materials:

Individual raw materials used are as follows:

(i) Active-Hydrogen-Containing Compounds

Polytetramethylene ether glycol, "PTMG1000", manufactured by Mitsubishi Chemical Corp.; functional group number: 2, and hydroxyl group value: 110 mg KOH/g Polytetramethylene ether glycol, "PTMG2000", manufactured by Mitsubishi Chemical Corp.; functional group number: 2, and hydroxyl group value: 56 mg KOH/g Polytetramethylene ether glycol, "PTMG3000", manufactured by Mitsubishi Chemical Corp.; functional group number: 2, and hydroxyl group value: 37 mg KOH/g Polycaprolactone polyol, "PLACCEL 210N (PCL210N)", manufactured by Daicel Chemical Industries, Ltd.; functional group number: 2, and hydroxyl group value: 110 mg KOH/g Polycaprolactone polyol, "PLACCEL 220 (PCL220)", manufactured by Daicel Chemical Industries, Ltd.; functional group number: 2, and hydroxyl group value: 56 mg KOH/g Polycaprolactone polyol, "PLACCEL 305 (PCL305)", manufactured by Daicel Chemical Industries, Ltd.; functional group number: 3, and hydroxyl group value: 305 mg KOH/g Propylene oxide adduct of glycerin, "T400", manufactured by Mitsui Chemicals, Inc.; functional group number: 3, and hydroxyl group value: 405 mg KOH/g Propylene oxide adduct of trimethylolpropane, "EXCENOL 400 MP", manufactured by Asahi Glass Co., Ltd.; functional group number: 3, and hydroxyl group value: 410 mg KOH/g 1,4-Butanediol (1,4-BD), manufactured by Nacalai Tesque Inc.; functional group number: 2, and hydroxyl group value: 1,247 mg KOH/g Diethylene glycol (DEG), manufactured by Nacalai Tesque Inc.; functional group number: 2, and hydroxyl group value: 1,057 mg KOH/g Propylene glycol (PG), manufactured by Nacalai Tesque Inc.; functional group number: 2, and hydroxyl group value: 1,472 mg KOH/g Trimethylolpropane, manufactured by Nacalai Tesque Inc.; functional group number: 3, and hydroxyl group value: 1,254 mg KOH/g Propylene oxide adduct of trimethylolpropane, "EXCENOL 890 MP", manufactured by Asahi Glass Co., Ltd.; functional group number: 3, and hydroxyl group value: 865 mg KOH/g (ii) Foaming Agents "B8443", manufactured by Goldschmidt GmbH.

"B8465", manufactured by Goldschmidt GmbH.

"L-5340", manufactured by Dow Corning Toray Co., Ltd.

(iii) Isocyanate Components

Carbodiimide-modified diphenylmethane diisocyanate (MDI), "MILLIONATE MTL", manufactured by Nippon Polyurethane Industry Co., Ltd.

Polymeric MDI, "MILLIONATE MR200", manufactured by Nippon Polyurethane Industry Co., Ltd.

(iv) Additives

Polyethylene glycol (PEG1000), manufactured by Dai-Ichi Kogyo Seiyaku Co., Ltd.; functional group number: 2, and hydroxyl group value: 110 mg KOH/g Diethylene glycol monoethyl ether (EtODEG), manufactured by Nacalai Tesque Inc.; functional group number: 1, and hydroxyl group value: 418 mg KOH/g

Examples 1 to 22, and Comparative Examples 1 to 22

Active-hydrogen-containing compounds, a foaming agent and an additive were charged into a container to give blend proportions in the upper columns in one of Tables 1 to 4 (each of numbers therein represents the number of parts by weight of one of the raw materials when the total amount of the active-hydrogen-containing compounds is regarded as 100 parts by weight). Stirring vanes were used to stir the blended components vigorously at a rotation number of 900 rpm for about 4 minutes to take bubbles into the reaction system. Thereafter, an isocyanate component (the number represents the number of parts by weight of the component when the total amount of the active-hydrogen-containing compounds is regarded as 100 parts by weight) was added thereto, and the reaction system was stirred for 1 minute to prepare each foam-dispersed urethane composition.

The prepared foam-dispersed urethane composition was painted onto a releasing sheet that was a PET sheet (manufactured by Toyobo Co., Ltd.; thickness: 75 μm) subjected to releasing treatment to form a foam-dispersed urethane layer. The foam-dispersed urethane layer was covered with a substrate layer that was a PET sheet (manufactured by Toyobo Co., Ltd., thickness: 188 μm). A nip roll was used to make the foam-dispersed urethane layer into a thickness of 1.3 mm, and the workpiece was primarily cured at 40° C. for 30 minutes. Thereafter, the workpiece was secondly cured at 70° C. for 2 hours to form a polyurethane foam (foamed layer). This production process corresponds to a one-shot process since the active-hydrogen-containing compounds were caused to react directly with the isocyanate component to produce the polyurethane foam.

Figure 2:
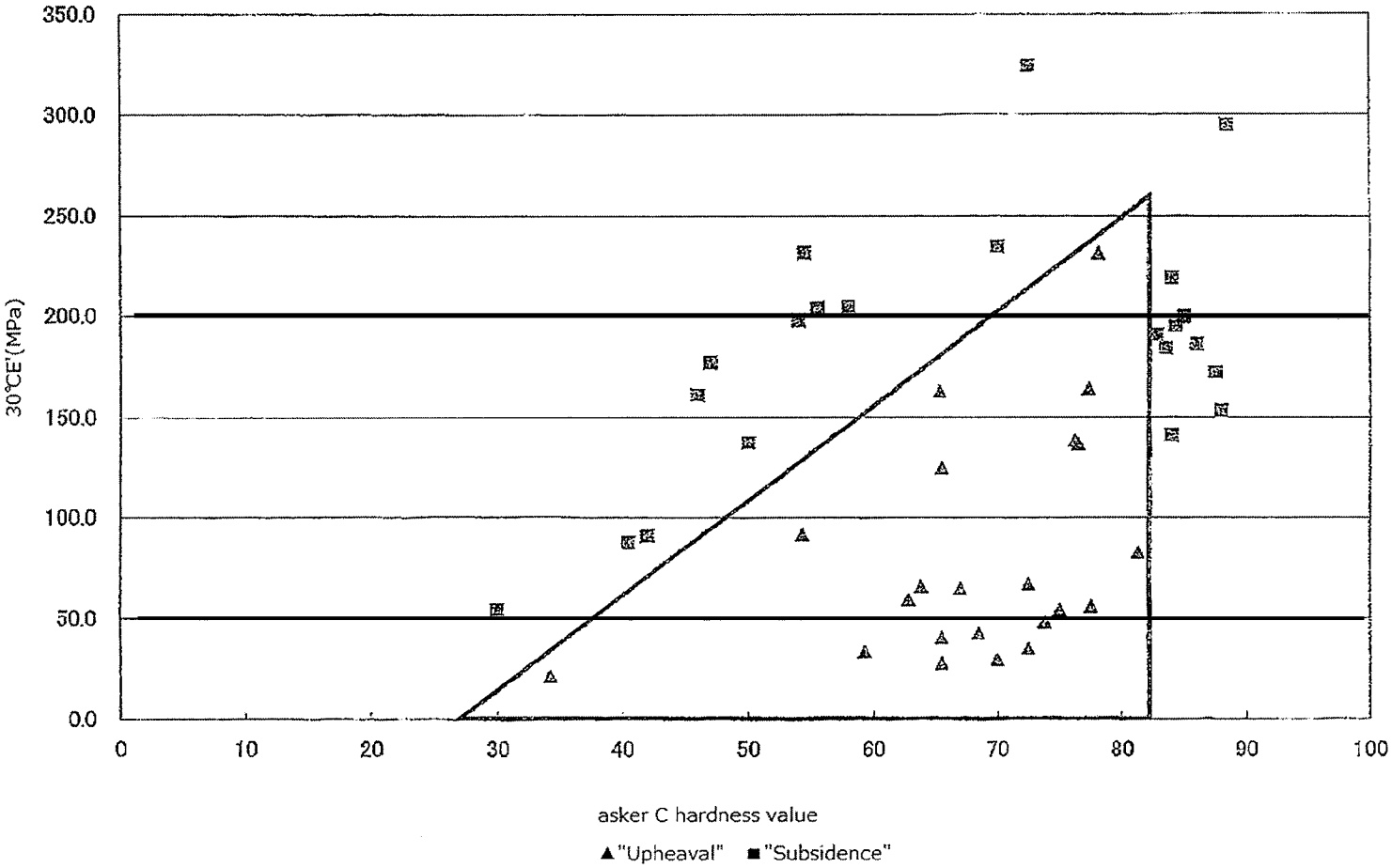
FIG. 2 is a graph showing a relationship between the tensile storage modulus E' (MPa) and the Asker C hardness value (60-second value) thereof after the substrate is immersed in water for 24 hours.

Thereafter, the releasing sheet was peeled. Next, a slicer (manufactured by Fecken-Kirfel Gmbh) was used to make the polyurethane foam into a thickness of 1.0 mm. In this way, the precision of the thickness was adjusted. Thereafter, a laminator was used to bond a double-sided tape (Double Tack Tape, manufactured by Sekisui Chemical Co., Ltd.) onto the front surface of the substrate layer to produce a polishing pad. The produced polishing pad was used to polish the glass substrate roughly. In a graph shown in FIG. 2, its vertical axis "30° CE' (MPa)" represents "the tensile storage modulus E' (30° C.) (MPa) at a frequency of 1.6 Hz"; and its horizontal axis "wet C hardness" represents the asker C hardness value (60-second value) after the glass substrate was immersed in water for 24 hours". The word "Upheaval" represents, any glass substrate the edge region of which was in "an upheaved form" after the rough polishing; and the word "Subsidence" represents any glass substrate the edge region of which was "in an edge-subsidence" after the substrate was finish-polished.

TABLE 1

| | | Example 1 | Example 2 | Example 3 | Example 4 | Example 5 | Example 6 |
|---|---|---|---|---|---|---|---|
| Polyol | PTMG1000 | 65 | | | | | |
| | PTMG2000 | | | | | | |
| | PTMG3000 | | | 60 | 65 | 70 | 63 |
| | PCL210N | | | | | | |
| | PCL220 | | 65 | | | | |

TABLE 1-continued

| | | | | | | | |
|---|---|---|---|---|---|---|---|
| | PCL305 | 20 | 20 | 25 | 20 | 15 | 25 |
| | T400 | | | | | | |
| | 400MP | | | | | | |
| | 1,3BD | | | | | | |
| | 1,4BD | 13 | 13 | 13 | 13 | 13 | 10 |
| | DEG | | | | | | |
| | PG | | | | | | |
| | 890MP | 2 | 2 | 2 | 2 | 2 | 2 |
| Additives | PEG1000 | | 10 | | | | |
| | EtODEG | | | | | | |
| Foaming agents | B8443 | | | 6 | 6 | 6 | 6 |
| | B8465 | 6 | | | | | |
| | L5340 | | 6 | | | | |
| Isocyanates | MTL | 84.55 | 85.75 | 78.91 | 75.1 | 71.29 | 68.6 |
| | MR200 | | | | | | |
| Properties | Dub off (nm) | 196.6 | 265.0 | 31.8 | 95.9 | 88.3 | 74.0 |
| | Polishing rate (Å/min) | 4856 | 4778 | 4500 | 4711 | 4344 | 4611 |
| | Tiny undulations (nm) | 0.684 | 0.687 | 0.522 | 0.732 | 0.482 | 0.524 |
| | Specific gravity | 0.501 | 0.461 | 0.479 | 0.469 | 0.483 | 0.496 |
| | Wet C hardness | 68.5 | 65.5 | 77.5 | 72.5 | 70 | 75 |
| | 30° CE' (MPa) | 42.4 | 27.9 | 55.8 | 35.1 | 29.6 | 54.1 |

| | | | Example 7 | Example 8 | Example 9 | Example 10 | Example 11 |
|---|---|---|---|---|---|---|---|
| | Polyol | PTMG1000 | | | 65 | 65 | 68 |
| | | PTMG2000 | | | | | |
| | | PTMG3000 | 65 | 30 | | | |
| | | PCL210N | | 30 | | | |
| | | PCL220 | | | | | |
| | | PCL305 | 25 | 25 | 20 | 20 | 20 |
| | | T400 | | | | | |
| | | 400MP | | | | | |
| | | 1,3BD | | | | | |
| | | 1,4BD | 8 | 13 | 13 | 13 | 10 |
| | | DEG | | | | | |
| | | PG | | | | | |
| | | 890MP | 2 | 2 | 2 | 2 | 2 |
| | Additives | PEG1000 | | | | | |
| | | EtODEG | | | | | |
| | Foaming agents | B8443 | 6 | 6 | 6 | 6 | 6 |
| | | B8465 | | | | | |
| | | L5340 | | | | | |
| | Isocyanates | MTL | 61.72 | 85.12 | 96.63 | 96.63 | 86.06 |
| | | MR200 | | | | | |
| | Properties | Dub off (nm) | 93.8 | 43.2 | 38.8 | 26.3 | 208.4 |
| | | Polishing rate (Å/min) | 3908 | 4489 | 5111 | 4478 | 4611 |
| | | Tiny undulations (nm) | 0.708 | 0.419 | 0.483 | 0.473 | 0.507 |
| | | Specific gravity | 0.496 | 0.498 | 0.479 | 0.643 | 0.489 |
| | | Wet C hardness | 72.5 | 76.5 | 67 | 76.2 | 59.3 |
| | | 30° CE' (MPa) | 67.2 | 136.4 | 64.8 | 138.0 | 33.5 |

TABLE 2

| | | Example 12 | Example 13 | Example 14 | Example 15 | Example 16 | Example 17 |
|---|---|---|---|---|---|---|---|
| Polyol | PTMG1000 | 58 | | | | 65 | |
| | PTMG2000 | | 65 | | | | |
| | PTMG3000 | | | 65 | 57 | | |
| | PCL210N | | | | | | |
| | PCL220 | | | | | | 65 |
| | PCL305 | 30 | 20 | 20 | | | |
| | T400 | | | | | 20 | |

TABLE 2-continued

| | | | | | | | |
|---|---|---|---|---|---|---|---|
| | 400MP | | | | 35 | | 20 |
| | 1,3BD | | | | | | |
| | 1,4BD | 10 | 13 | 13 | 8 | 13 | 13 |
| | DEG | | | | | | |
| | PG | | | | | | |
| | 890MP | 2 | 2 | 2 | | 2 | 2 |
| Additives | PEG1000 | | | | | | 10 |
| | EtODEG | | | | | | |
| Foaming agents | B8443 | 6 | 6 | 6 | 6 | | 6 |
| | B8465 | | | | | | |
| | L5340 | | | | | 6 | |
| Isocyanates | MTL | 92.1 | 85.75 | 81.93 | 74.08 | | |
| | MR200 | | | | | 88.7 | 78.58 |
| Properties | Dub off (nm) | 96.4 | 16.5 | 33.3 | 51.1 | 36.9 | 46.3 |
| | Polishing rate (Å/min) | 4589 | 4677 | 4389 | 4400 | 4511 | 4356 |
| | Tiny undulations (nm) | 0.367 | 0.603 | 0.508 | 0.495 | 0.404 | 0.336 |
| | Specific gravity | 0.509 | 0.479 | 0.461 | 0.440 | 0.452 | 0.492 |
| | Wet C hardness | 65.5 | 65.5 | 73.8 | 62.8 | 77.3 | 65.3 |
| | 30° CE' (MPa) | 124.8 | 40.5 | 48.2 | 59.2 | 163.7 | 162.5 |

| | | Example 18 | Example 19 | Example 20 | Example 21 | Example 22 |
|---|---|---|---|---|---|---|
| Polyol | PTMG1000 | | | | 68 | |
| | PTMG2000 | | | | | |
| | PTMG3000 | | | 55 | | 72 |
| | PCL210N | | 60 | | | |
| | PCL220 | 70 | | | | |
| | PCL305 | 20 | 20 | 30 | | |
| | T400 | | | | | |
| | 400MP | | | | 20 | 15 |
| | 1,3BD | | | | | 8 |
| | 1,4BD | 8 | 18 | 13 | 10 | |
| | DEG | | | | | |
| | PG | | | | | |
| | 890MP | 2 | 2 | 2 | 2 | 5 |
| Additives | PEG1000 | | | | 10 | |
| | EtODEG | | | | | |
| Foaming agents | B8443 | | | 6 | | 6 |
| | B8465 | 6 | | | 6 | |
| | L5340 | | 6 | | | |
| Isocyanates | MTL | | | 78.95 | | 65.22 |
| | MR200 | 55.09 | 97.96 | | 75.26 | |
| Properties | Dub off (nm) | 152.4 | 22.4 | 21.4 | 143.6 | 119.4 |
| | Polishing rate (Å/min) | 4512 | 4627 | 4259 | 4528 | 4444 |
| | Tiny undulations (nm) | 0.513 | 0.357 | 0.429 | 0.362 | 0.455 |
| | Specific gravity | 0.463 | 0.453 | 0.438 | 0.472 | 0.463 |
| | Wet C hardness | 34.2 | 78.1 | 81.3 | 54.3 | 63.8 |
| | 30° CE' (MPa) | 21.3 | 231.5 | 82.4 | 91.5 | 66.0 |

TABLE 3

| | | Comparative Example 1 | Comparative Example 2 | Comparative Example 3 | Comparative Example 4 | Comparative Example 5 | Comparative Example 6 |
|---|---|---|---|---|---|---|---|
| Polyol | PTMG1000 | | | 65 | 65 | | |
| | PTMG3000 | | | | | | |
| | PCL210N | 65 | 65 | | | | |
| | PCL220 | | | | | 65 | 65 |
| | PCL305 | 20 | | | | | |
| | T400 | | 20 | 20 | | | 20 |
| | 400MP | | | | 20 | 20 | |
| | 1,3BD | | | | | | |
| | 1,4BD | | | | | | |
| | DEG | 13 | | 13 | | | 13 |

TABLE 3-continued

| | | | | | | | |
|---|---|---|---|---|---|---|---|
| | PG | | 13 | | 13 | 13 | |
| | TMP | | | | | | |
| | 890MP | 2 | 2 | 2 | 2 | 2 | 2 |
| Additives | PEG1000 | | 10 | 10 | | | |
| | EtODEG | | | | 5 | | 5 |
| Foaming agents | B8443 | 6 | | 6 | | 6 | |
| | B8465 | | | | | | 6 |
| | L5340 | | 6 | | 6 | | |
| Isocyanates | MTL | 81.57 | 98.44 | 95.8 | 102.28 | 88.11 | 77.85 |
| | MR200 | | | | | | |
| Properties | Dub off (nm) | −25.5 | −48.9 | −14.3 | −75.4 | 42.1 | −106.2 |
| | Polishing rate (Å/min) | 4533 | 3800 | 4444 | 4500 | 4550 | 3756 |
| | Tiny undulations (nm) | 0.300 | 0.270 | 0.403 | 0.290 | 0.343 | 0.497 |
| | Specific gravity | 0.452 | 0.497 | 0.480 | 0.450 | 0.447 | 0.448 |
| | Wet C hardness | 47 | 72.5 | 50 | 70 | 84 | 30 |
| | 30° CE' (MPa) | 177.0 | 324.5 | 137.2 | 234.9 | 219.1 | 54.4 |

| | | | Comparative Example 7 | Comparative Example 8 | Comparative Example 9 | Comparative Example 10 | Comparative Example 11 |
|---|---|---|---|---|---|---|---|
| | Polyol | PTMG1000 | | | | | |
| | | PTMG3000 | | | 45 | 25 | 45 |
| | | PCL210N | 65 | | | 25 | |
| | | PCL220 | | 65 | | | |
| | | PCL305 | | | 40 | 35 | |
| | | T400 | | 20 | | | 40 |
| | | 400MP | 20 | | | | |
| | | 1,3BD | | | | | |
| | | 1,4BD | | | | | |
| | | DEG | 13 | | 13 | 13 | 13 |
| | | PG | | 13 | | | |
| | | TMP | | | | | |
| | | 890MP | 2 | 2 | 2 | 2 | 2 |
| | Additives | PEG1000 | | | | | |
| | | EtODEG | | | | | |
| | Foaming agents | B8443 | | | 6 | 6 | 6 |
| | | B8465 | | | | | |
| | | L5340 | 6 | | | | |
| | Isocyanates | MTL | | 95.07 | 83.32 | 91.7 | 95.81 |
| | | MR200 | 88.75 | | | | |
| | Properties | Dub off (nm) | −8.5 | −61.4 | −41.9 | −28.1 | −168.6 |
| | | Polishing rate (Å/min) | 4722 | 5000 | 5078 | 4900 | 5233 |
| | | Tiny undulations (nm) | 0.310 | 0.448 | 0.342 | 0.319 | 0.350 |
| | | Specific gravity | 0.466 | 0.451 | 0.488 | 0.484 | 0.462 |
| | | Wet C hardness | 83.5 | 88.5 | 88 | 82.8 | 84 |
| | | 30° CE' (MPa) | 184.0 | 294.6 | 153.2 | 190.9 | 140.6 |

TABLE 4

| | | Comparative Example 12 | Comparative Example 13 | Comparative Example 14 | Comparative Example 15 | Comparative Example 16 | Comparative Example 17 |
|---|---|---|---|---|---|---|---|
| Polyol | PTMG1000 | | | | 30 | 30 | |
| | PTMG3000 | 45 | 25 | | | | |
| | PCL210N | | 25 | 62.5 | | | 60 |
| | PCL220 | | | | | | |
| | PCL305 | | | 24.5 | 55 | 55 | 25 |
| | T400 | | | | | | |
| | 400MP | 40 | 35 | | | | |
| | 1,3BD | | | | | | |
| | 1,4BD | | | | | | |
| | DEG | 13 | 13 | 11 | 13 | | 15 |
| | PG | | | | | 13 | |
| | TMP | | | 2 | 2 | 2 | |
| | 890MP | 2 | 2 | | | | |

TABLE 4-continued

| | | | | | | | |
|---|---|---|---|---|---|---|---|
| Additives | PEG1000 | | | | | | |
| | EtODEG | | | | | | |
| Foaming agents | B8443 | 6 | 6 | 6 | 6 | 6 | 6 |
| | B8465 | | | | | | |
| | L5340 | | | | | | |
| Isocyanates | MTL | 94.11 | 94.14 | 80.9 | 103.2 | 118.5 | 85.4 |
| | MR200 | | | | | | |
| Properties | Dub off (nm) | −64.7 | −124.5 | −126.6 | −10.7 | −11.3 | −128.9 |
| | Polishing rate (Å/min) | 5000 | 5275 | 4198 | 4785 | 4739 | 4206 |
| | Tiny undulations (nm) | 0.955 | 0.719 | 0.335 | 0.538 | 0.529 | 0.415 |
| | Specific gravity | 0.430 | 0.483 | 0.488 | 0.450 | 0.445 | 0.460 |
| | Wet C hardness | 85 | 84.3 | 55.5 | 86 | 87.5 | 54.5 |
| | 30° CE' (MPa) | 199.5 | 194.9 | 204.1 | 185.8 | 171.8 | 231.8 |

| | | Comparative Example 18 | Comparative Example 19 | Comparative Example 20 | Comparative Example 21 | Comparative Example 22 |
|---|---|---|---|---|---|---|
| Polyol | PTMG1000 | | 60 | | | |
| | PTMG3000 | | | | | |
| | PCL210N | 60 | | 70 | 65 | 65 |
| | PCL220 | | | | | |
| | PCL305 | 25 | 25 | 15 | 20 | 25 |
| | T400 | | | | | |
| | 400MP | | | | | |
| | 1,3BD | | | | | |
| | 1,4BD | | | | | |
| | DEG | 13 | 13 | 13 | 5 | 8 |
| | PG | | | | | |
| | TMP | | | | | |
| | 890MP | 2 | 2 | 2 | 10 | 2 |
| Additives | PEG1000 | | | | | |
| | EtODEG | | | | | |
| Foaming agents | B8443 | 6 | 6 | 6 | 6 | 6 |
| | B8465 | | | | | |
| | L5340 | | | | | |
| Isocyanates | MTL | 84.3 | 84.3 | 78.8 | 77.2 | 70.9 |
| | MR200 | | | | | |
| Properties | Dub off (nm) | −103.6 | −20.7 | −165.7 | −179.2 | −98.3 |
| | Polishing rate (Å/min) | 4218 | 4439 | 4108 | 4382 | 4500 |
| | Tiny undulations (nm) | 0.328 | 0.424 | 0.338 | 0.396 | 0.287 |
| | Specific gravity | 0.456 | 0.445 | 0.466 | 0.476 | 0.402 |
| | Wet C hardness | 54 | 40.5 | 46 | 58 | 42 |
| | 30° CE' (MPa) | 197.9 | 87.7 | 160.9 | 204.8 | 90.8 |

According to the results in Table 2, in the glass substrate polished roughly by use of each of the polishing pads of Examples 1 to 22, its edge region was in an "upheaved form", so that the glass substrate produced by the finish polishing was a glass substrate having an excellent flatness at not only a central region thereof but also an edge region thereof. By contrast, about the glass substrate polished roughly by use of each of the polishing pads of Comparative Examples 1 to 22, the form of an edge region thereof was substantially flat. As a result, the edge region was made into an "edge-subsidence" by the finish polishing.

The invention claimed is:

1. A polishing pad having a polishing layer comprising a thermoset polyurethane foam, wherein about the thermoset polyurethane foam, the Asker C hardness value thereof is 82 or less as a 60-second value, the hardness value being a value after the foam is immersed in water for 24 hours, and further the value of the tensile storage modulus E' (30° C.) thereof at a frequency of 1.6 Hz satisfies the following expression (1):

$$Y<5X-150 \quad (1)$$

wherein Y represents the tensile storage modulus E' (MPa), and X represents the Asker C hardness value (60-second value) after the foam is immersed in water for 24 hours.

2. The polishing pad according to claim 1, wherein the thermoset polyurethane foam comprises, as raw material components, an isocyanate component, and active-hydrogen-containing compounds comprising 5 to 20% by weight of a polyol compound having a functional group number of 2 and a hydroxyl group value of 1,100 to 1,400 mg KOH/g, and 10 to 40% by weight of a polyol compound having a functional group number of 3 and a hydroxyl group value of 200 to 600 mg KOH/g.

3. The polishing pad according to claim 1, wherein about the thermoset polyurethane foam, the Asker C hardness value thereof, as the 60-second value, is 75 or less, the hardness value being a value after the foam is immersed in water for 24 hours.

4. The polishing pad according to claim 1, wherein the value of the tensile storage modulus E' (30° C.) at the frequency of 1.6 Hz is 100 MPa or less.

5. The polishing pad according to claim 1, wherein the thermoset polyurethane foam has substantially spherical continuous bubbles having an average bubble diameter of 20 to 300 μm.

6. A method for producing a glass substrate, comprising the step of:

providing the polishing pad of claim 1; and polishing a glass substrate using the polishing pad.

* * * * *